US007682403B2

(12) United States Patent
Gohl et al.

(10) Patent No.: US 7,682,403 B2
(45) Date of Patent: Mar. 23, 2010

(54) METHOD FOR TREATING LAUNDRY

(75) Inventors: David W. Gohl, St. Paul, MN (US); John Birckbichler, Mendota Heights, MN (US); Brandon Carlson, Farmington, MN (US); Terry J. Klos, Victoria, MN (US); Julio Rey Panama, Blaine, MN (US); Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 234 days.

(21) Appl. No.: 10/754,491

(22) Filed: Jan. 9, 2004

(65) Prior Publication Data

US 2005/0153859 A1 Jul. 14, 2005

(51) Int. Cl.
*D06L 1/12* (2006.01)

(52) U.S. Cl. ..... 8/137; 8/111

(58) Field of Classification Search ..... 8/111, 8/137

See application file for complete search history.

(56) References Cited

U.S. PATENT DOCUMENTS

| | | | | | |
|---|---|---|---|---|---|
| 2,220,099 | A | | 11/1940 | Guenther et al. | |
| 2,477,383 | A | | 7/1949 | Lewis | |
| 3,042,621 | A | * | 7/1962 | Kirschenbauer | 510/100 |
| 3,131,991 | A | * | 5/1964 | Lindner et al. | 8/137 |
| 3,308,067 | A | | 3/1967 | Diehl | |
| 3,718,597 | A | * | 2/1973 | Werdehausen et al. | 510/303 |
| 3,909,114 | A | | 9/1975 | Haas et al. | |
| 3,933,672 | A | | 1/1976 | Bartolotta et al. | |
| 3,936,537 | A | | 2/1976 | Baskerville, Jr. et al. | |
| 4,093,417 | A | * | 6/1978 | Heinlein et al. | 8/137 |
| 4,118,189 | A | * | 10/1978 | Reinwald et al. | 8/137 |
| 4,136,045 | A | | 1/1979 | Gault et al. | |
| 4,144,226 | A | | 3/1979 | Crutchfield et al. | |
| 4,220,562 | A | | 9/1980 | Spadini et al. | |
| 4,222,905 | A | | 9/1980 | Cockrell | |
| 4,228,044 | A | | 10/1980 | Cambre | |
| 4,239,659 | A | | 12/1980 | Murphy | |
| 4,303,542 | A | * | 12/1981 | Heinlein et al. | 510/283 |
| 4,312,634 | A | * | 1/1982 | Katz | 8/111 |
| 4,388,077 | A | * | 6/1983 | Ruck | 8/138 |
| 4,403,994 | A | * | 9/1983 | Hignett | 8/111 |
| 4,412,934 | A | | 11/1983 | Chung et al. | |
| 4,483,781 | A | | 11/1984 | Hartman | |
| 4,515,704 | A | | 5/1985 | Akred | |
| 4,530,780 | A | | 7/1985 | Van de Pas et al. | |
| 4,556,504 | A | | 12/1985 | Rek | |
| 4,618,446 | A | | 10/1986 | Haslop et al. | |
| 4,619,779 | A | | 10/1986 | Hardy | |
| 4,634,551 | A | | 1/1987 | Burns et al. | |
| 4,657,784 | A | | 4/1987 | Olson | |
| 4,663,071 | A | | 5/1987 | Bush et al. | |
| 4,663,081 | A | | 5/1987 | Grimshaw et al. | |
| 4,681,914 | A | | 7/1987 | Olson et al. | |
| 4,731,195 | A | | 3/1988 | Olson | |
| 4,793,943 | A | | 12/1988 | Haslop et al. | |
| 4,830,733 | A | | 5/1989 | Nagji et al. | |
| 4,871,467 | A | | 10/1989 | Akred et al. | |
| 4,909,953 | A | | 3/1990 | Sadlowski et al. | |
| 4,988,363 | A | * | 1/1991 | Barnes | 8/111 |
| 4,992,194 | A | | 2/1991 | Liberati et al. | |
| 5,006,273 | A | | 4/1991 | Machin et al. | |
| 5,021,195 | A | | 6/1991 | Machin et al. | |
| 5,073,285 | A | | 12/1991 | Liberati et al. | |
| 5,108,644 | A | | 4/1992 | Machin et al. | |
| 5,122,538 | A | | 6/1992 | Lokkesmoe et al. | |
| 5,160,655 | A | | 11/1992 | Donker et al. | |
| 5,200,189 | A | | 4/1993 | Oakes et al. | |
| 5,213,705 | A | | 5/1993 | Olson | |
| 5,281,356 | A | | 1/1994 | Tsaur et al. | |
| 5,320,805 | A | | 6/1994 | Kramer et al. | |

(Continued)

FOREIGN PATENT DOCUMENTS

CA 2023990 AA 2/1991

(Continued)

OTHER PUBLICATIONS

U.S. Appl. No. 10/739,922, filed Dec. 18, 2003, entitled An Acidic Detergent And A Method Of Cleaning Articles In A Dish Machine Using An Acidic Detergent (60 pgs).

(Continued)

*Primary Examiner*—Lorna M Douyon
(74) *Attorney, Agent, or Firm*—Andrew D. Sorensen; Laura C. DiLorenzo

(57) ABSTRACT

A method for treating laundry is provided. The method includes steps of applying a bleaching and antimicrobial composition to laundry in a laundry washing machine at a first pH that favors bleaching properties and at a second pH that favors antimicrobial properties, wherein the first pH and the second pH are different, and draining the bleaching and antimicrobial composition from the laundry. The step of applying a bleaching and antimicrobial composition to laundry can include a step of washing the laundry with a detergent composition for the removal of soil. In addition, the step of applying a bleaching and antimicrobial composition to laundry can precede or follow a step of washing laundry with a detergent composition for the removal of soil. A bleaching and antimicrobial composition and a laundry washing machine are provided.

12 Claims, 5 Drawing Sheets

U.S. PATENT DOCUMENTS

| | | | | | |
|---|---|---|---|---|---|
| 5,476,519 | A | | 12/1995 | Haslop et al. | |
| 5,505,740 | A | * | 4/1996 | Kong et al. | 8/111 |
| 5,610,318 | A | * | 3/1997 | Jaekel et al. | 548/479 |
| 5,633,223 | A | | 5/1997 | Vasudevan et al. | |
| 5,674,828 | A | | 10/1997 | Knowlton et al. | |
| 5,716,923 | A | * | 2/1998 | MacBeath | 510/313 |
| 5,952,285 | A | | 9/1999 | Hawkins | |
| 5,958,852 | A | | 9/1999 | Yianakopoulos et al. | |
| 5,964,692 | A | | 10/1999 | Blezard et al. | |
| 5,972,870 | A | * | 10/1999 | Anderson | 510/298 |
| 6,090,762 | A | | 7/2000 | Clapperton et al. | |
| 6,166,095 | A | | 12/2000 | Bryan et al. | |
| 6,177,396 | B1 | | 1/2001 | Clapperton et al. | |
| 6,194,371 | B1 | | 2/2001 | Donovan et al. | |
| 6,200,586 | B1 | | 3/2001 | Lambie et al. | |
| 6,225,276 | B1 | * | 5/2001 | Gassenmeier et al. | 510/376 |
| 6,262,013 | B1 | | 7/2001 | Smith et al. | |
| 6,358,910 | B1 | * | 3/2002 | Boskamp et al. | 510/446 |
| 6,407,052 | B2 | * | 6/2002 | Gassenmeier et al. | 510/441 |
| 6,413,927 | B1 | | 7/2002 | Horne et al. | |
| 6,514,556 | B2 | | 2/2003 | Hilgren et al. | |
| 6,693,069 | B2 | | 2/2004 | Korber et al. | |
| 6,962,714 | B2 | * | 11/2005 | Hei et al. | 424/405 |
| 7,378,380 | B2 | * | 5/2008 | Blagg et al. | 510/108 |
| 2003/0162682 | A1 | | 8/2003 | Lentsch et al. | |
| 2003/0162685 | A1 | | 8/2003 | Man et al. | |
| 2003/0195130 | A1 | | 10/2003 | Lentsch et al. | |
| 2004/0033269 | A1 | * | 2/2004 | Hei et al. | 424/616 |
| 2004/0072710 | A1 | * | 4/2004 | McKechnie et al. | 510/302 |
| 2004/0173244 | A1 | * | 9/2004 | Strothoff et al. | 134/25.2 |

FOREIGN PATENT DOCUMENTS

| | | | | |
|---|---|---|---|---|
| CA | 2077253 | AA | | 3/1993 |
| EP | 151884 | A2 | | 8/1985 |
| EP | 0 206 418 | A | | 12/1986 |
| EP | 295021 | A2 | | 12/1988 |
| EP | 303473 | A2 | | 2/1989 |
| EP | 354010 | A2 | | 2/1990 |
| EP | 0 396 287 | A | | 11/1990 |
| EP | 430330 | A2 | | 6/1991 |
| EP | 452106 | A2 | | 10/1991 |
| EP | 0 623 670 | A2 | | 11/1994 |
| EP | 0 658 620 | A1 | | 12/1994 |
| EP | 1 067 174 | A | | 1/2001 |
| GB | 1 456 592 | A | | 11/1976 |
| GB | 2000177 | A | * | 1/1979 |
| GB | 2223235 | A1 | | 4/1990 |
| GB | 2304754 | A1 | | 3/1997 |
| WO | WO 96/16156 | | | 5/1996 |
| WO | WO 96/18713 | | | 6/1996 |
| WO | WO 96/33254 | | | 10/1996 |
| WO | WO 97/00938 | | | 1/1997 |
| WO | WO 97/10321 | | | 3/1997 |
| WO | WO 97/11145 | | | 3/1997 |
| WO | WO 98/53131 | | | 11/1998 |
| WO | WO 01/48136 | A1 | | 7/2001 |
| WO | WO 02/06434 | A1 | * | 1/2002 |

OTHER PUBLICATIONS

U.S. Appl. No. 10/754,426, filed Jan. 9, 2004, entitled Medium Chain Peroxycarboxylic Acid Compositions (139 pgs).

U.S. Appl. No. 10/600,091, filed Jun. 20, 2003, entitled Method And Apparatus For Cleaning Wither Intermediate Concentration Compositions (32 pgs).

Kirk-Othmer, Encyclopedia of Chemical Technology, Third Edition, vol. 5, pp. 339-366 and vol. 23, pp. 319-320.

Boltenhagen, P. et al., "Freeze-fracture observations in the L.alpha. phase of a swollen surfactant in the vicinity of the L3 and the L1 phase transitions", *J. Phys. II*, vol. 4, No. 8, pp. 1439-1448 (1994). (Abstract only).

Doerfler, H. et al., "Influence of glycerol on the formation of lyotropic mesophases—microscopic texture observations for determining preliminary phase diagrams of binary K-soap/glycerol systems", *Colloid Polym. Sci.*, vol. 271, No. 2, pp. 173-189 (1993). (Abstract only).

Dubois, M. et al., "Phase behavior and scattering of double-chain surfactants in diluted aqueous solutions", *Langmuir*, vol. 7, No. 7, pp. 1352-1360 (1991). (Abstract only).

Porte, G. et al., "Mixed amphiphilic bilayers: bending elasticity and formation of vesicles",*J. Chem. Phys.*, vol. 102, No. 10, pp. 4290-4298 (1995). (Abstract only).

* cited by examiner

METHOD FOR TREATING LAUNDRY

FIELD OF THE INVENTION

The invention is directed at a laundry treatment composition, a method for treating laundry, and an apparatus for treating laundry. In particular, laundry can be treated with a laundry treatment composition at a first condition that favors bleaching properties and at a second condition that favors antimicrobial properties. The first condition and the second condition can refer to a first pH and a second pH, respectively. The laundry treatment composition can be provided as part of a laundry cleaning operation and can be utilized in industrial and commercial applications and in residential applications.

BACKGROUND OF THE INVENTION

In industrial and commercial laundry facilities, textile materials such as sheets, towels, wipes, garments, table cloths, etc. are laundered at elevated temperatures with alkaline detergents. The alkaline detergents typically contain a source of alkalinity such as an alkali metal hydroxide, alkali metal silicate, alkali metal carbonate or other base component. Additionally, the alkaline detergents typically contain surfactants or other detergent materials that can enhance soil removal from the textile materials. The detergents can also contain other components such as bleaches, brightening agents, antiredeposition agents, etc. that are used to enhance the appearance of the resulting textile materials. The textile materials that have been treated with an alkaline detergent are typically treated with a commercial or industrial sour composition that contains acid components for neutralizing alkaline residues on the fabric to enhance skin compatibility. A fabric sour composition that provides sanitizing properties is described by U.S. Pat. No. 6,262,013 to Smith et al.

In a conventional, industrial laundry washing facility, textile materials can be subjected to several treatment steps in an industrial sized laundry washing machine to provide cleaning. Exemplary treatment steps include a presoak step, a wash step that often occurs at a pH of about 11 to 12, a rinse step for the removal of soil containing wash liquor, a bleach step at a pH of about 10, several rinse steps to remove the bleaching composition, a sour step that reduces the pH to a level of about 5, and an extract step that often involves spinning the textiles to remove water.

Efforts are underway to improve the industrial laundry washing techniques and provide a reduction in processing time, cost of materials, materials consumption, energy costs, and water consumption. Exemplary techniques for improving cleaning are described in U.S. Pat. No. 6,262,013 to Smith et al. and International Publication No. WO 01/48136 A1.

SUMMARY OF THE INVENTION

A method for treating laundry is provided according to the invention. The method includes steps of applying a bleaching and antimicrobial composition to laundry in a laundry washing machine at a first pH that favors bleaching properties and at a second pH that favors antimicrobial properties, wherein the first pH and the second pH are different, and draining the bleaching and antimicrobial composition from the laundry. The step of applying a bleaching and antimicrobial composition to laundry can include a step of washing the laundry with a detergent composition for the removal of soil. In addition, the step of applying a bleaching and antimicrobial composition to laundry can precede or follow a step of washing laundry with a detergent composition for the removal of soil.

A bleaching and antimicrobial composition is provided according to the invention. The bleaching and antimicrobial composition includes a bleaching/antimicrobial agent and a coated pH adjusting agent. The bleaching/antimicrobial agent can be at least one of a halogen bleach and an oxygen bleach. The coated pH adjusting agent is provided for time delayed and/or time controlled release of the pH adjusting agent so that the bleaching and antimicrobial composition can be adjusted between the first pH and the second pH. The pH adjusting agent can cause the bleaching and antimicrobial composition to change from a first pH to a second pH or from a second pH to a first pH.

A laundry washing machine is provided according to the invention. The laundry washing machine includes a drum having an interior for holding laundry, a motor constructed and arranged for rotating the drum, a water inlet for introducing water into the drum interior, a chemical inlet for introducing chemicals into the drum interior, a drain for allowing fluid to drain from the drum interior, and a processing unit constructed for operating the laundry washing machine. The processing unit can be constructed to provide a washing cycle for washing laundry with a detergent use solution, a rinsing cycle for removing at least a portion of the detergent use solution, and a treatment cycle for treating laundry with a bleaching and antimicrobial composition at a first pH that favors bleaching properties and at a second pH that favors antimicrobial properties. The laundry washing machine can include a second chemical inlet for introducing a pH adjusting agent for adjusting the bleaching and antimicrobial composition between the first pH and the second pH.

DETAILED DESCRIPTION OF THE INVENTION

Figure 1:
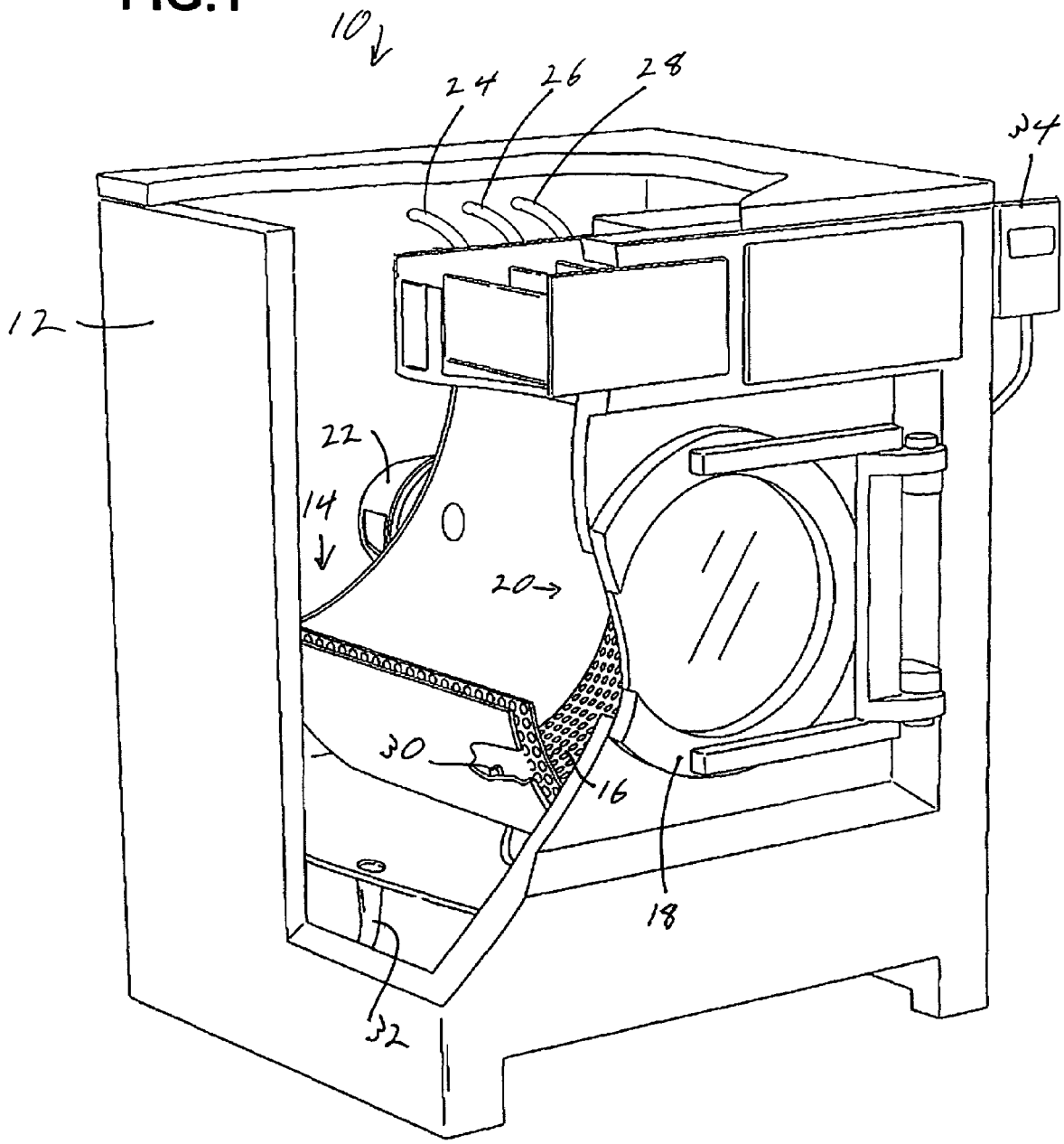
FIG. 1 is a perspective, partial cutaway view of a laundry washing machine according to the principles of the present invention.

The invention provides a laundry treatment composition, a method for treating laundry, and an apparatus for treating laundry. It should be understood that the term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

The laundry treatment composition can provide for bleaching and antimicrobial treatment and can be referred to as the bleaching and antimicrobial composition or more simply as the treatment composition. The treatment composition can be provided in the form of a concentrate that is diluted with water to provide a use solution. The use solution can be used for washing articles such as laundry.

The method for treating laundry according to the invention can be provided as part of an overall method for cleaning laundry according to the invention. That is, as part of a laundry cleaning operation, the laundry can be treated with a bleaching and antimicrobial composition to provide bleaching and antimicrobial properties. The antimicrobial properties can be characterized as sanitizing when there is a substantial reduction of bacteria, fungi, spores, and other microorganisms or microorganism generating materials on a surface being treated to provide a sanitized surface. A substantial reduction refers to a reduction of at least three orders of magnitude and can be referred to as a three-$\log_{10}$ reduction. Preferably, the reduction can be at least five orders of magnitude. The reference to "cleaning" refers to at least one of the removal of soil, the removal of staining or the appearance of staining, and the reduction of a population of microbes. A cleaning process can include all three of the removal of soil, the removal of staining or the appearance of staining, and the reduction of a population of microbes.

The method for treating laundry refers to the treatment of laundry with a bleaching and antimicrobial composition at a first condition that favors bleaching properties and at a second condition that favors antimicrobial properties. The first and second conditions can refer to different pH values and can be characterized as a first pH and a second pH, respectively. The treatment composition can be subjected to a condition shift from the first condition to the second condition or vice versa. When the first condition and the second condition refer to a first pH and a second pH, respectively, the treatment composition can be subjected to a pH shift from the first pH to the second pH or vice versa.

In the context of the statement that a first condition favors bleaching properties and a second condition favors antimicrobial properties, or that a first condition favors antimicrobial properties and a second condition favors bleaching properties, it should be understood that the term "favors" reflects a general preference for a particular activity at the identified condition such as a pH environment. In general, it is expected that the preference refers to a speed and sufficiency that provides desirable results whether the operation is carried out commercially or residentially. That is, bleaching is expected to occur sufficiently quickly when bleaching properties are favored, and antimicrobial properties are expected to occur sufficiently quickly when antimicrobial properties are favored. Although a particular activity may be favored in one environment, other activities can also occur in that environment. For example, although bleaching properties may be favored at the first pH, it is expected that antimicrobial properties may also occur at the first pH. Similarly, although the second pH may favor antimicrobial properties, it is expected that a certain amount of bleaching may occur at the second pH. It should be understood that characterizing a condition as favoring a particular activity does not require the absence of another activity at that condition.

The method for treating laundry can be provided in a commercial and/or industrial laundry washing facility and can be provided in a residential and/or home laundry washing machine. Exemplary commercial and/or industrial laundry washing facilities include those cleaning textiles for the rental, health care, and hospitality industries. In addition, the method for treating laundry can occur as part of an operation that includes additional steps, such as, washing, rinsing, finishing, and extracting. In addition, it should be understood that the step of treating laundry can include, as part of the step, additional activities such as, for example, washing and finishing.

It is expected that many commercial and industrial laundry washing machines are capable of handling the method for treating laundry according to the invention. Many commercial and industrial laundry washing machines are computer programmable, and computer programs can be provided to operate the machines according to the invention. In addition, it is expected that machines can be made available to treat laundry according to the invention, and that these machines can be used in both industrial or commercial applications and in home and residential applications. In addition, the treatment composition can be formulated so that it can be used in commercial and industrial laundry washing machines and residential laundry washing machines that are in common use, that are not computer programmable, and without modification. That is, it is expected that conventional laundry washing machines can be used to treat laundry according to the invention.

An examplary laundry washing machine is shown in FIG. 1 at reference number 10. The laundry washing machine 10 can be characterized as a front loading washer. Although a front loading washer is shown, it should be understood that the principles of the invention apply to a top loading washer. Laundry washing machines that can be used according to the invention can be characterized as horizontal axis or vertical axis washers depending upon the axis of rotation. The laundry washing machine 10 can be characterized as a horizontal axis washer. In addition, tunnel washers and continuous bath washers can be utilized according to the invention.

The laundry washing machine 10 includes a housing 12. Within the housing 12 is provided a drum 14 that rotates to provide agitation between laundry and the wash liquor. The wash liquor refers to the liquid composition in contact with the laundry. The wash liquor can include a detergent use composition, a bleaching and antimicrobial composition, a rinse composition, a finishing composition, etc. The drum 14 includes an interior surface 16 for holding the laundry. A door 18 is provided for accessing the drum 14 opening 20 to move laundry into and out of the laundry washing machine 10.

A motor 22 is provided for causing the drum 14 to rotate. A chemical feed 24 is provided for introducing chemical into the drum 14. The chemical introduced can be a detergent composition, a bleaching and antimicrobial composition, a finishing composition, etc. A water inlet 26 is provided for introducing water into the drum 14. The water can be introduced through the water inlet 26 for diluting the chemical introduced through the chemical line 24. Alternatively, water can be combined with the chemicals to dilute the chemicals to provide a use composition and then introduced through the chemical line 24. It is expected that water will be introduced through the water inlet 26 at least for the purpose of rinsing the laundry. Additionally provided is a second chemical inlet 28. The second chemical inlet 28 can be provided for introducing various chemicals into the drum 14. For example, the second chemical inlet 28 can be used to introduce a pH adjusting agent to change the pH of the composition provided within the drum 14. It should be understood that the second chemical inlet 28 can be considered optional. For example, the treatment composition can be provided so that a condition shift, such as a pH shift, occurs without the addition of another ingredient. In addition, if the treatment composition is provided that utilizes the addition of another component such as a pH adjusting agent, the component can be introduced through the chemical line 24.

A sensor 30 can be provided for sensing the conditions within the drum 14. That is, the liquor inside the drum 14 can pass through the drum interior 16 and contact with the sensor 30. The sensor can report pH conditions within the drum 14. If desired, the sensor can report other conditions or additional conditions including temperature and/or concentration.

The laundry washing machine 10 includes a drain 32 and a processor 34. The processor 34 is provided for operating the laundry washing machine 10. The processor 34 can be programmable to provide for operating the laundry washing machine 10 according to the method of the invention. In addition, the processor 34 can be provided for running the machine 10 and can be provided as the interface for dispensing. It should be understood that a processor is not a required component for treating laundry according to the invention. For example, the laundry washing machine can have a timer that causes the machine to move through various steps or operations, and the bleaching and antimicrobial step can be provided as part of a washing or finishing step, or can be provided as a separate step. In addition, the bleaching and antimicrobial step can be provided without providing addition of a separate component such as a pH adjusting agent.

The method for treating laundry according to the invention includes a bleaching and antimicrobial step. This bleaching and antimicrobial step can follow or precede steps of washing the laundry with a detergent use solution and draining and/or rinsing the detergent use solution from the laundry. In other applications, it is expected that the bleaching and antimicrobial step can occur simultaneously with the washing step. It is expected that in situations where the soiling is relatively light, it may be advantageous to combine the washing step with the bleaching and antimicrobial step. That is, the bleaching and antimicrobial step can include a soil removal step and/or it can occur before or after a soil removal step.

The laundry can be treated with a bleaching and antimicrobial composition to provide a desired level of stain removal and microbe removal. The step of treating the laundry with a bleaching and antimicrobial composition can include a pH shift so that during the treatment step, the composition is provided at a first pH that favors bleaching and then provided at a second pH that favors antimicrobial properties, or vice versa. In addition, the pH shift can occur as a result of adding additional components to the treatment composition or the components of the treatment composition can themselves cause the pH shift. It should be understood that the reference to a "step" of treating with a bleaching and antimicrobial composition is not intended to exclude addition of a chemical component (such as a pH adjusting agent) to provide a condition shift (such as a pH shift) as part of that step. A washing step can be distinguished from a treatment step when, for example, the washing step includes a draining of the wash liquor followed by addition of the treatment composition even though there is expected or carryover alkalinity or acidity. In the context of the present invention, the treatment step can be considered terminated with the removal of greater than 90% of the maximum water level obtained during the treatment step.

In the context of one embodiment of a laundry washing operation, it is expected that the laundry will undergo a laundry washing step in the presence of a detergent use solution. At least a portion of the detergent use solution can be drained from the laundry prior to the step of treating the laundry with a bleaching and antimicrobial composition. Alternatively, at least a portion of the detergent use solution can be drained from the laundry and the laundry can be rinsed to further remove the detergent use solution from the laundry prior to the step of treating the laundry with a bleaching and antimicrobial composition. Various techniques for washing laundry with a detergent use solution can be utilized according to the invention for cleaning laundry prior to the step of treating with a bleaching and antimicrobial composition. The detergent use solution can be an alkaline or an acid detergent use solution. Techniques for acid cleaning are described in German Publication No. DE 101 50 403 A1 that was published on Apr. 30, 2003, the entire disclosure of which is incorporated herein by reference. Additional techniques for acid cleaning are disclosed in U.S. application Ser. No. 10/739,922 (United States Patent Application Publication Number 2005/0137105) that was filed with the U.S. Patent and Trademark Office on Dec. 18, 2003, the entire disclosure of which is incorporated herein by reference. Various techniques for cleaning that include alkaline cleaning are described in United States Patent Application Publication No. 2003/0162682 that was filed with the United States Patent and Trademark Office on Aug. 28, 2003, and U.S. Pat. No. 6,194,371 that was filed on Feb. 7, 2001,the entire disclosures of which is incorporated herein by reference. Additional techniques for cleaning laundry are described in U.S. application Ser. No. 10/600,091 (United States Patent Application Publication Number 2004/0259754) that was filed with the United States Patent and Trademark Office on Jun. 20, 2003, the entire disclosure of which is incorporated herein by reference. In general, it is expected that an alkaline wash refers to a wash that takes place at a pH at between about 7 and about 13, and can include a pH of between about 8 and about 12. In general, it is understood that an acid wash refers to a wash having a pH of between about 1 and about 6, and can refer to a wash having a pH in the range of about 2 to about 4.

When the laundry is treated with a composition such as a detergent composition prior to the step of treating with the bleaching and antimicrobial composition, it is expected that a certain amount of carryover alkalinity or acidity or detergency may occur. It should be understood that the phrases "carryover alkalinity" and "carryover acidity" refer to the chemistry that is contained within the laundry (that has not been completely removed) that is available for the next step. For example, when the detergent use solution provides an alkaline environment, it is expected that the detergent use solution will provide a certain amount of carryover alkalinity for a subsequent bleaching and antimicrobial treatment step unless all of the detergent use solution is removed by rinsing. Similarly, when the detergent use solution provides for acidic washing, it is expected that a carryover acidity will be provided for the next step unless all of the use solution is removed. By expecting a carryover effect, one can select the bleaching and antimicrobial composition that takes advantage of the carryover effect.

When the detergent use solution includes a source of alkalinity, unless all of the detergent use solution is removed during a rinsing step, it is expected that some amount of the alkalinity will remain and provide an environment during the treatment step that is relatively alkaline. Because many detergent use solutions provide a generally alkaline environment and because bleaching is generally favored in an alkaline environment, it is expected that the step of treating with a bleaching and antimicrobial composition can be provided at a pH that favors bleaching prior to a pH that favors antimicrobial properties in order to minimize the pH swing during the treatment step. Accordingly, it is possible to take advantage of the carryover alkalinity by providing a first pH in an alkaline environment. In general, a higher pH favors bleaching properties and a lower pH favors antimicrobial properties. After providing the desired bleaching effect, the pH of the bleaching and antimicrobial composition can be reduced to favor antimicrobial properties. When the detergent use solution provides an acidic environment, it is expected that there may be a carryover acidity for the step of treating with the bleaching and antimicrobial composition. When a carryover acidity is expected, the bleaching and antimicrobial composition can be formulated to take advantage of the carryover acidity by providing the antimicrobial treatment prior to the bleaching treatment.

It should be understood that the pH of the bleaching and antimicrobial use composition can be effected as a result of carryover from the washing step and/or by additional ingredients provided within the bleaching and antimicrobial composition. Accordingly, the components of the bleaching and antimicrobial composition can be designed to provide the use composition with a desired or target pH in view of an expected carryover effect or if there is no expected carryover effect. Furthermore, the pH reduction or increase that occurs during the bleaching and antimicrobial treatment step can be provided as a result of an introduction of pH adjusting agent. It should be understood that the term "introduction" can refer to the physical introduction of a component that was not previously present by, for example, adding the component. In addition, the term "introduction" can refer to the exposure of a component to the environment which can occur, for example, after a reaction to form the component and/or after a coating over the component has degraded sufficiently to allow the component to interact with the composition.

Treatment Composition

The bleaching and antimicrobial composition can be referred to as the treatment composition, and the step of treating using the bleaching and antimicrobial composition can be referred to as the treatment step. The treatment composition, when in use, can be referred to as the treatment use composition or the treatment use solution. During the treatment step, it is desirable to provide the treatment use composition at a pH that favors bleaching in order to effect the desired level of bleaching, and at a pH that favors antimicrobial treatment in order to effect a desired level of antimicrobial treatment. It should be understood that the order in which the treatment composition is provided at the different pH levels can be changed as desired. For example, the treatment composition can be provided at a pH that favors bleaching first and at a pH that favors antimicrobial treatment second. In addition, the treatment composition can be provided at a pH that favors antimicrobial treatment first and at a pH that favors bleaching second. However, in order to take advantage of the possible carryover effect from a prior washing step that utilizes an alkaline detergent use solution, it can be advantageous to provide the treatment use composition with a pH that favors bleaching prior to a pH that favors antimicrobial properties. Alternatively, in order to take advantage of the possible carryover effect from a prior washing step that utilizes an acidic detergent use solution, it can be advantageous to provide the treatment use composition with a pH that favors antimicrobial properties prior to a pH that favors bleaching.

When the bleaching and antimicrobial composition is provided at a pH that favors bleaching, it is desirable to provide the pH at a level and time sufficient to provide the desired bleaching effect. It is expected that the pH will be provided at between about 5 and about 11, between about 7 and about 11, and between about 8 and about 10. The length of time sufficient to provide a desired level of bleaching often depends on the laundry washing machine that is being used. In general, it is expected that sufficient bleaching can occur at a time of between about 1 and about 20 minutes, at a time of between about 2 and about 15 minutes, and a time of between about 3 minutes and about 10 minutes. Of course, the amount of time often depends on the staining involved and on the temperature of the treatment composition. The temperature of the composition can be provided at room temperature (about 60° F.) to about 165° F. Lowering the pH allows the treatment composition to favor antimicrobial properties. The pH of the treatment composition for providing antimicrobial properties can be between about 2 and about 8, between about 2 and about 6, and between about 2 and about 4. In general, it is expected that the amount of time at the pH that favors antimicrobial properties will be between about 1 minute and about 20 minutes, between about 2 minutes and about 15 minutes, and between about 3 minutes and about 10 minutes.

The pH of the treatment composition can be provided as a result of the carryover effect, if present, from a prior step such as a washing step. In addition, the pH of the treatment composition can be provided as a result of components in the treatment composition. The treatment composition can initially be provided with a pH that favors bleaching and the pH can be adjusted by the introduction of a pH adjusting agent to provide a pH that favors antimicrobial properties. Alternatively, the treatment composition can be provided with a pH that favors antimicrobial properties and the pH can be adjusted by the introduction of a pH adjusting agent to provide a pH that favors bleaching.

The pH Adjusting Agent

The pH of the treatment composition can be adjusted by the introduction of a pH adjusting agent that can be an acid or a base. The pH adjusting agent can be added to the treatment use composition when it is desired to provide the pH shift. Alternatively, the pH adjusting agent can be provided as part of the treatment composition and can be provided in a form that allows it to take effect at a certain point in time. For example, the pH adjusting agent can be coated in a manner that provides for release of the pH adjusting agent after a length of time. In addition, the pH adjusting agent can be a component that is generated as a result of a reaction. Accordingly, the pH adjusting agent can provide the desired pH shift to a second pH after the composition has been provided at the first pH for a desired length of time.

When the pH adjusting agent is used to increase the pH, it can be referred to as an alkaline agent. Exemplary alkaline agents include alkali metal hydroxides, such as sodium hydroxide, potassium hydroxide, and mixtures thereof, alkali metal silicates such as sodium metal silicate, alkaline metal carbonates, alkaline metal bicarbonates, alkaline metal sesquicarbonates, and alkaline metal borates. Sodium hydroxide can be used in an aqueous solution and in a variety of solid forms in varying particle sizes. The carbonate and borate sources are typically used in place of alkaline metal hydroxide when a lower pH is desired.

When the pH adjusting agent is used to lower the pH, it can be referred to as an acidifying agent. Exemplary acidifying agents include inorganic acids, organic acids, and mixtures of inorganic acids and organic acids. Exemplary inorganic acids that can be used include mineral acids such as sulfuric acid, nitric acid, hydrochloric acid, and phosphoric acid. Exemplary organic acids that can be used include carboxylic acids including monocarboxylic acids and polycarboxcylic acids such as dicarboxcylic acids. Exemplary carboxylic acids include aliphatic and aromatic carboxylic acids. Exemplary aliphatic carboxylic acids include acetic acid, formic acid, halogen-containing carboxylic acids such as chloroacetic carboxylic acid, and modified carboxylic acids containing side groups such —OH, —R, —OR, —$(EO)_x$, —$(PO)_x$, —$NH_2$, and —$NO_2$ wherein R is a $C_1$ to $C_{10}$ alkyl group. Exemplary aromatic carboxylic acids include benzoic carboxylic acid, salicylic carboxylic acid, and aromatic carboxylic acid modified to include as a side group at least one of halogen, —OH, —R, —OR, —$(EO)_x$, —$(PO)_x$, —$NH_2$, and —$NO_2$ wherein R is a $C_1$ to $C_{10}$ alkyl group. Additional exemplary organic acids include oxalic acid, phthlaic acid, sebacic acid, adipic acid, citric acid, maleic acid, and modified forms thereof containing side groups including halogen, —OH, —R, —OR, —$(EO)_x$, —$(PO)_x$, —$NH_2$, and —$NO_2$ wherein R is a $C_1$ to $C_{10}$ alkyl group. It should be understood that the subscript "x" refers to repeating units. Additional exemplary organic acids include fatty acids such as aliphatic fatty acids and aromatic fatty acids. Exemplary aliphatic fatty acids include oleic acid, palmitic acid, stearic acid, $C_3$-$C_{26}$ fatty acids that may be saturated or unsaturated, and sulfonated forms of fatty acids. An exemplary aromatic fatty acid includes phenylstearic acid. Additional acids that can be used include peroxycarboxylic acid such as peroxyacetic acid, and phthalimidopercarboxylic acids. Additional acidic pH adjusting agents include carbon dioxide and ozone.

The pH adjusting agent can be a component of the treatment composition to provide the first pH, and then a pH adjusting agent can be introduced to cause a pH shift to the second pH. The introduction of the pH adjusting agent can occur by adding the pH adjusting agent and/or by allowing the pH adjusting agent to cause a pH shift. For example, the pH adjusting agent can be formed in situ by reaction and/or the pH adjusting agent can be coated and, once the coating is degraded, the pH adjusting agent can become exposed to the treatment composition.

The coating and in situ reaction techniques are examples of techniques that provide for a delayed release of pH adjusting agent. It is expected that other techniques for delayed release can be utilized. Exemplary coatings that can be used to coat the pH adjusting agent include cellulose and cellulose derivatives. Exemplary cellulose derivatives include water soluble cellulose ethers such as $C_{1-4}$ alkyl cellulose, carboxy $C_{1-4}$ alkyl cellulose, hydroxy $C_{1-4}$ alkyl callulose, di $C_{1-4}$ alkyl carboxy cellulose, $C_{1-4}$ hydroxy $C_{1-4}$ cellulose, $C_{1-4}$ alkyl hydroxy $C_{1-4}$ alkyl cellulose and mixtures thereof. More specific examples include hydroxyethylcellulose and hydroxypropylcellulose. Exemplary coating techniques and compositions that can be used include those described in U.S. Pat. Nos. 5,213,705; 4,830,733; 4,731,195; 4,681,914; and 4,657,784; the disclosures of coating techniques and compositions are incorporated herein by reference.

The Bleaching and Antimicrobial Agent

The bleaching and antimicrobial composition can include an agent or agents that provide bleaching properties, an agent or agents that provide antimicrobial properties, and agents that provide both bleaching and antimicrobial properties. The agents that provide both bleaching and antimicrobial properties can be referred to as bleaching/antimicrobial agents. Exemplary bleaching/antimicrobial agents include halogen bleaches and oxygen bleaches.

Halogen bleaches that can be used include those that provide a source of active halogen. Sources of active halogen provide free elemental halogen or —OX—wherein X is Cl or Br under use conditions for the beaching and antimicrobial composition. Halogen bleaches typically release chlorine or bromine species. Halogen bleaches that release chlorine are commonly used in the laundry industry. Chlorine releasing compounds include chlorine dioxide, potassium dichloroisocyanurate, sodium dichloroisocyanurate, chlorinated trisodiumphosphate, sodium hypochlorite, calcium hypochlorite, lithium hypochlorite, monochloramine, dichloroamine, [(monotrichloro)-tetra (monopotassium dichloro)]pentaisocyanurate, paratoluene sulfondichloro-amide, trichloromelamine, N-chlorammeline, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethyl hydantoin, 1-3-dichloro-5-ethyl-5-methyl hydantoin, 1-choro-3-bromo-5-ethyl-5-methyl hydantoin, dichlorohydantoin, salts or hydrates thereof, and mixtures thereof. An organic chlorine releasing compound can be sufficiently soluble in water to have a hydrolysis constant (K) of about 10-4 or greater.

Exemplary chlorine bleaches include alkali metal salts of chloroisocyanurate, hydrates thereof, and mixtures thereof. Dichloroisocyanurate dihydrate, an exemplary chlorine releasing compound, is commercially available from, for example, Monsanto or FMC. This compound can be represented by the formula:

$$NaCl_2C_3N_3O_32H_2O$$

When the treatment composition is provided as concentrate and includes a halogen bleach, the halogen bleach can be provided in an amount sufficient to provide a use composition exhibiting bleaching when bleaching conditions are favored and exhibiting antimicrobial properties when antimicrobial properties are favored. It is expected that the concentrate, when it contains a halogen bleach, will contain halogen bleach in an amount of between about 1 wt. % and about 20 wt. %, and can include an amount of halogen bleach of between about 5 wt. % and about 15 wt. %, and between about 8 wt. % and about 12 wt. %.

Oxygen bleaches that can be used include those that provide a source of active oxygen. Sources of active oxygen can include inorganic compositions, organic compositions, and mixtures of inorganic and organic compositions. Examples of sources of active oxygen include peroxygen compounds and peroxygen compound adducts. Exemplary peroxygen compositions that can be used include inorganic peroxygen compositions, organic peroxygen compositions, and mixtures thereof.

Examples of inorganic active oxygen compositions that can be used include the following types of compositions or sources of compositions, or alkali metal salts, or adducts, or mixtures:

hydrogen peroxide;

ozone;

group 1 (IA) active oxygen compounds, for example lithium peroxide, sodium peroxide, and the like;

group 2 (IIA) active oxygen compounds, for example magnesium peroxide, calcium peroxide, strontium peroxide, barium peroxide, and the like;

group 12 (IIB) active oxygen compounds, for example zinc peroxide, and the like;

group 13 (IIIA) active oxygen compounds, for example boron compounds, such as perborates, for example sodium perborate hexahydrate of the formula $Na_2[Br_2(O_2)_2(OH)_4].6H_2O$ (also called sodium perborate tetrahydrate and formerly written as $NaBO_3.4H_2O$); sodium peroxyborate tetrahydrate of the formula $Na_2Br_2(O_2)_2[(OH)_4].4H_2O$ (also called sodium perborate trihydrate, and formerly written as $NaBO_3.3H_2O$); sodium peroxyborate of the formula $Na_2[B_2$ $(O_2)_2(OH)_4]$ (also called sodium perborate monohydrate and formerly written as $NaBO_3.H_2O$); and the like; preferably perborate;

group 14 (IVA) active oxygen compounds, for example persilicates and peroxycarbonates, which are also called percarbonates, such as persilicates or peroxycarbonates of alkali metals; and the like; preferably percarbonate;

group 15 (VA) active oxygen compounds, for example peroxynitrous acid and its salts; peroxyphosphoric acids and their salts, for example, perphosphates; and the like; preferably perphosphate;

group 16 (VIA) active oxygen compounds, for example peroxysulfuric acids and their salts, such as peroxymonosulfuric and peroxydisulfuric acids, and their salts, such as persulfates, for example, sodium persulfate; and the like; preferably persulfate;

group VIIa active oxygen compounds such as sodium periodate, potassium perchlorate and the like.

Other active inorganic oxygen compounds can include transition metal peroxides; and other such peroxygen compounds, and mixtures thereof.

The compositions and methods can employ certain of the inorganic active oxygen compounds listed above. Exemplary inorganic active oxygen compounds include hydrogen peroxide, hydrogen peroxide adduct, ozone, group IIIA active oxygen compound group, VIA active oxygen compound, group VA active oxygen compound, group VIIA active oxygen compound, or mixtures thereof. Examples of inorganic active oxygen compounds include percarbonate, perborate, persulfate, perphosphate, persilicate, or mixtures thereof. Hydrogen peroxide can be formulated as a mixture of hydrogen peroxide and water, e.g., as liquid hydrogen peroxide in an aqueous solution. The mixture of solution can include about 5 to about 50 wt. % hydrogen peroxide.

Exemplary inorganic active oxygen compounds include hydrogen peroxide adducts. The inorganic active oxygen compounds can include hydrogen peroxide, hydrogen peroxide adduct, or mixtures thereof. Any of a variety of hydrogen peroxide adducts are suitable for use in the present compositions and methods. For example, suitable hydrogen peroxide adducts include alkali metal percarbonate salt, urea peroxide, peracetyl borate, an adduct of $H_2O_2$ and polyvinyl pyrrolidone, sodium percarbonate, potassium percarbonate, mixtures thereof, or the like. Preferred hydrogen peroxide adducts include percarbonate salt, urea peroxide, peracetyl borate, an adduct of $H_2O_2$ and polyvinyl pyrrolidone, or mixtures thereof. Preferred hydrogen peroxide adducts include sodium percarbonate, potassium percarbonate, or mixtures thereof, preferably sodium percarbonate.

Active oxygen compound adducts include those that can function as a source of active oxygen. Exemplary oxygen compound adducts include hydrogen peroxide adducts, peroxyhydrates, alkali metal percarbonates, for example sodium percarbonate (sodium carbonate peroxyhydrate), potassium percarbonate, rubidium percarbonate, cesium percarbonate, and the like; ammonium carbonate peroxyhydrate, and the like; urea peroxyhydrate, peroxyacetyl borate; an adduct of $H_2O_2$ polyvinyl pyrrolidone, and the like, and mixtures of any of the above.

When the treatment composition is provided as a concentrate and includes an inorganic active oxygen bleach component, the inorganic active oxygen bleach component can be provided in an amount that provides for bleaching properties when bleaching properties are favored and provides for antimicrobial properties when antimicrobial properties are favored. In general, it is expected that this will correspond to an amount of inorganic active oxygen bleach in the treatment composition concentrate of between about 0.5 wt. % and about 50 wt. %. It is expected that the inorganic active oxygen bleach, when present, can be provided in the treatment composition concentrate in an amount of between about 5 wt. % and about 45 wt. %, and can be provided in an amount of between about 30 wt. % and about 40 wt. %. In the case of ozone, it is expected that the amount of ozone sufficient to provide bleaching and antimicrobial properties when the bleaching properties are favored and when the antimicrobial properties are favored can be characterized based on the use composition. It is expected that ozone can be present in the use composition in an amount of between about 0.1 ppm and about 10 ppm, and can be present in an amount of between about 0.5 ppm and about 5 ppm, and can be present in an amount of between about 1 ppm and about 2 ppm.

Any of a variety of organic active oxygen compounds can be employed in the compositions and methods of the present invention. For example, the organic active oxygen compound can be a peroxycarboxylic acid, such as a mono- or di-peroxycarboxylic acid or an ester peroxycarboxylic acid, an alkali metal salt including these types of compounds, or an adduct of such a compound. Exemplary peroxycarboxylic acids include $C_1$-$C_{24}$ peroxycarboxylic acid, salt of $C_1$-$C_{24}$ peroxycarboxylic acid, ester of $C_1$-$C_{24}$ peroxycarboxylic acid, diperoxycarboxylic acid, salt of diperoxycarboxylic acid, ester of diperoxycarboxylic acid, or mixtures thereof.

Exemplary peroxycarboxylic acids include $C_1$-$C_{10}$ aliphatic peroxycarboxylic acid, salt of $C_1$-$C_{10}$ aliphatic peroxycarboxylic acid, ester of $C_1$-$C_{10}$ aliphatic peroxycarboxylic acid, or mixtures thereof; salts of or adducts of peroxyacetic acid such as peroxyacetyl borate. Exemplary diperoxycarboxylic acids include $C_4$-$C_{10}$ aliphatic diperoxycarboxylic acid, salt of $C_4$-$C_{10}$ aliphatic diperoxycarboxylic acid, or ester of $C_4$-$C_{10}$ aliphatic diperoxycarboxylic acid, or mixtures thereof; and sodium salt of perglutaric acid, of persuccinic acid, of peradipic acid, or mixtures thereof. Additional exemplary peroxycarboxylic acids include phthalimido-percarboxylic acid such as phthalimidoperhexanoic acid and phthalimidoperoctanoic as described in U.S. application Ser. No. 10/168,426 filed on Jun. 21, 2002, the entire disclosure being incorporated herein by reference.

Organic active oxygen compounds include other acids including an organic moiety. Exemplary organic active oxygen compounds include perphosphonic acids, perphosphonic acid salts, perphosphonic acid esters, or mixtures or combinations thereof.

The bleaching and antimicrobial composition can include one or more carboxylic acids and one or more peroxycarboxylic acids with a peroxygen compound such as hydrogen peroxide, $H_2O_2$. Typically, however, the composition contains one or more carboxylic acids, an oxidizer, and one or more peroxycarboxylic acids depending on equilibrium. The peroxycarboxylic acid material can be made by oxidizing a carboxylic acid directly to the peroxycarboxylic acid material which is then solubilized in the aqueous compositions. Further, the materials can be made by combining the unoxidized acid with a peroxygen compound such as hydrogen peroxide and/or ozone to generate the peracid in situ prior to blending the peroxycarboxylic acid with other constituents. This is described in U.S. Pat. No. 5,122,538, incorporated by reference herein. The resulting composition can be characterized as follows:

| Component | Exemplary Range (wt. %) | Exemplary Range (wt. %) | Exemplary Range (wt. %) |
|---|---|---|---|
| carboxylic acid | 1-80 | 20-60 | 20-40 |
| peroxycarboxylic acid | 1-50 | 5-30 | 10-20 |
| oxidizer | 1-50 | 5-30 | 5-15 |

A carboxylic acid is an organic acid (R—COOH) which contains an aliphatic group and one or more carboxyl groups. A carboxyl group is represented by —COOH, and is usually located at a terminal end of the acid. The aliphatic group can be a substituted or unsubstituted group. Common aliphatic substituents may include —OH, —OR, —$NO_2$, halogen, and other substituents common on these groups. An example of a simple carboxylic acid is acetic acid, which has the formula $CH_3COOH$. A peroxycarboxylic acid is a carboxylic acid which has been oxidized to contain a terminal —COOOH group. The term peroxy acid is often used to represent a peroxycarboxylic acid. An example of a simple peroxy acid is peroxyacetic acid, which has the formula $CH_3COOOH$.

The peroxycarboxylic acid can be formulated by combining a monocarboxylic acid, such as acetic acid, with an oxidizer such as hydrogen peroxide and/or ozone. The result of this combination is a reaction producing a peroxycarboxylic acid, such as peroxyacetic acid, and water. The reaction follows an equilibrium in accordance with the following equation:

$$H_2O_2+CH_3COOH \rightleftharpoons CH_3COOOH+H_2O$$

wherein the $pK_{eq}$ is 1.7.

The importance of the equilibrium results from the presence of hydrogen peroxide, the carboxylic acid and the peroxycarboxylic acid in the same composition at the same time. Because of this equilibrium, a mixture of carboxylic acid and peroxycarboxylic acid can be combined in water without adding hydrogen peroxide. If permitted to approach equilibrium, the mixture will evolve hydrogen peroxide. This combination provides enhanced sanitizing with none of the deleterious environmental or organoleptic effects of other sanitizing agents, additives, or compositions.

Carboxylic acids have the formula R—COOH wherein the R may represent any number of different groups including aliphatic groups, alicyclic groups, aromatic groups, heterocyclic groups, all of which may be saturated or unsaturated. Carboxylic acids also occur having one, two, three, or more carboxyl groups. Aliphatic groups can be further differentiated into three distinct classes of hydrocarbons. Alkanes (or paraffins) are saturated hydrocarbons. Alkenes (or olefins) are unsaturated hydrocarbons which contain one or more double bonds and alkynes (or acetylenes) are unsaturated hydrocarbons containing one or more highly reactive triple bonds.

Alicyclic groups can be further differentiated into three distinct classes of cyclic hydrocarbons. Cycloparaffins are saturated cyclic hydrocarbons. Cycloolefins are unsaturated cyclic hydrocarbons which contain one or more double bonds while cycloacetylenes are unsaturated cyclic hydrocarbons containing one or more highly reactive triple bonds. Aromatic groups are defined as possessing the unsaturated hydrocarbon ring structure representative of benzene. Heterocyclic groups are defined as 5 or 6 member ring structures wherein one or more of the ring atoms are not carbon. An example is pyridine, which is essentially a benzene ring with one carbon atom replaced with a nitrogen atom.

Carboxylic acids have a tendency to acidify aqueous compositions in which they are present as the hydrogen atom of the carboxyl group is active and may appear as a cation. The carboxylic acid constituent within the present composition when combined with aqueous hydrogen peroxide generally functions as an antimicrobial agent as a result of the presence of the active hydrogen atom. Moreover, the carboxylic acid constituent within the invention maintains the composition at an acidic pH. The composition of the invention can utilize carboxylic acids containing as many as 10 carbon atoms. Examples of suitable carboxylic acids include formic, acetic, propionic, butanoic, pentanoic, hexanoic, heptanoic, octanoic, nonanoic, decanoic, lactic, maleic, ascorbic, citric, hydroxyacetic, neopentanoic, neoheptanoic, oxalic, malonic, succinic, glutaric, adipic, pimelic and subric acid.

Carboxylic acids which are generally useful are those having one or two carboxyl groups where the R group is a primary alkyl chain having a length of $C_2$ to $C_{10}$, preferably $C_2$ to $C_5$ and which are freely water soluble. The primary alkyl chain is that carbon chain of the molecule having the greatest length of carbon atoms and directly appending carboxyl functional groups. Especially useful are mono- and dihydroxy substituted carboxylic acids including alpha-hydroxy substituted carboxylic acid. A preferred carboxylic acid is acetic acid, which produces peroxyacetic acid to increase the sanitizing effectiveness of the materials.

An exemplary peroxycarboxylic acid composition that can be used according to the invention includes medium chain peroxycarboxylic compositions such as those containing peroxyoctanoic acid compositions. Exemplary medium chain peroxycarboxylic acid compositions that can be used include those described in U.S. application Ser. No. 10/754426 (United States Publication Number 2005/0152991) that was filed with the United States Patent and Trademark Office on Jan. 9, 2004, the entire disclosure of which is incorporated herein by reference.

The oxidized carboxylic acid or peroxycarboxylic acid provides heightened antimicrobial efficacy when combined with hydrogen peroxide and the carboxylic acid in an equilibrium reaction mixture. Peroxycarboxylic acids generally have the formula $R(CO_3H)_n$, where R is an alkyl, arylalkyl, cycloalkyl, aromatic or heterocyclic group, and n is one or two and named by prefixing the parent acid with peroxy. The alkyl group can be a paraffinic hydrocarbon group which is derived from an alkane by removing one hydrogen from the formula. The hydrocarbon group may be either linear or branched, having up to 9 carbon atoms. Simple examples include methyl($CH_3$) and ethyl($CH_2CH_3$). An arylalkyl group contains both aliphatic and aromatic structures. A cycloalkyl group is defined as a cyclic alkyl group.

While peroxycarboxylic acids are not very stable, their stability generally increases with increasing molecular weight. Thermal decomposition of these acids may generally proceed by free radical and nonradical paths, by photodecomposition or radical-induced decomposition, or by the action of metal ions or complexes.

Peroxycarboxylic acids may be made by the direct, acid catalyzed equilibrium action of 30-98 wt. % hydrogen peroxide with the carboxylic acid, by autoxidation of aldehydes, or from acid chlorides, acid anhydrides, or carboxylic anhydrides with hydrogen or 20 sodium peroxide.

Peroxycarboxylic acids useful in this invention include peroxyformic, peroxyacetic, peroxypropionic, peroxybutanoic, peroxypentanoic, peroxyhexanoic, peroxyheptanoic, peroxyoctanoic, peroxynonanoic, peroxydecanoic, peroxylactic, peroxymaleic, peroxyascorbic, peroxyhydroxyacetic, peroxyoxalic, peroxymalonic, peroxysuccinic, peroxyglutaric, peroxyadipic, peroxypimelic and peroxysubric acid and mixtures thereof. These peroxycarboxylic acids have been found to provide good antimicrobial action with good stability in aqueous streams.

Peroxyacetic acid is a peroxycarboxylic acid with a structure as given the formula:

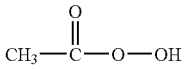

wherein the peroxy group, —O—O—, is considered a high energy bond. Generally, peroxyacetic acid is a liquid having an acrid odor and is freely soluble in water, alcohol, ether, and sulfuric acid. Peroxyacetic acid may be prepared through any number of means known to those of skill in the art including preparation from acetaldehyde and oxygen in the presence of cobalt acetate. A 50% solution of peroxyacetic acid may be obtained by combining acetic anhydride, hydrogen peroxide and sulfuric acid.

The treatment composition can provide antibacterial activity against a wide variety of microorganisms such as gram positive (for example, *Staphylococcus aureus*) and gram negative (for example, *Escherichia coli*) microorganisms, yeast, molds, bacterial spores, viruses, etc. When combined, the above peroxy acids can have enhanced activity compared to the low molecular weight peroxy acids alone.

When the treatment composition (of the concentrate) includes peroxycarboxylic acid, the peroxycarboxylic acid can be provided in an amount that provides the desired bleaching properties when bleaching conditions are favored and the desired antimicrobial properties when antimicrobial properties are favored. In general, it is expected that the treatment composition concentrate can include peroxycarboxylic acid in an amount of about 0.5 wt. % to about 50 wt. %. It is expected that the treatment composition concentrate can include peroxycarboxylic acid in an amount of about 5 wt. % to about 30 wt. %, and between about 10 wt. % and about 20 wt. %.

The treatment composition can be provided so that the treatment use composition includes a sufficient amount of the bleaching and antimicrobial agent to provide the desired amount of bleaching properties and antimicrobial properties in the desired length of time. In general, it is expected that the bleaching properties will determine the amount of the bleaching and antimicrobial agent for the composition. That is, it is expected that more of the bleaching and antimicrobial agent will be required for achieving the bleaching results than for providing the antimicrobial results. In general, the amount of the bleaching and antimicrobial agent used should be sufficient to provide the desired bleaching affect and antimicrobial affect. However, it should be understood that the upper amount of the bleaching and antimicrobial agent can be determined based upon cost considerations. It is expected that the amount of bleaching and antimicrobial agent in the use composition for treating laundry will be at least about 5 ppm, and can be between about 10 ppm and about 2,500 ppm, and can be between about 20 ppm and about 500 ppm. When used for hard surface cleaning (such as warewashing), the use composition can contain the bleaching and antimicrobial agent in an amount of at least about 1 ppm, between about 1 ppm and about 200 ppm, and between about 5 ppm and about 100 ppm.

Activators

In some embodiments, the antimicrobial activity and/or bleaching activity of the treatment composition can be enhanced by the addition of a material which, when the composition is placed in use, reacts or somehow interacts to form an activated component. For example, in some embodiments, a peracid or a peracid salt can be formed. For example, in some embodiments, tetraacetylethylene diamine can be included within the composition to react with active oxygen and form a peracid or a peracid salt that acts as an antimicrobial and bleaching agent. Other examples of active oxygen activators include transition metals and their compounds, compounds that contain a carboxylic, nitrate, or ester moiety, or other such compounds known in the art. Additional exemplary activators include sodium nonanonyloxydenzene sulfonate (NOBS), acetyl caprolactone, and N-methyl morpholinium acetonitrile and salts thereof (such as Sokalan BMG from BASF).

When the treatment composition includes an activator, the activator can be provided in the concentrate in an amount of between about 0.1 wt. % and about 20 wt. %, between about 0.5 wt. % and about 10 wt. %, and between about 1 wt. % and about 5 wt. %.

Additional Components

The bleaching and antimicrobial treatment can be provided as a finishing step or as a step intended to be followed by subsequent steps. For example, the use of the treatment composition can be followed by subsequent rinsing and/or finishing steps to impart desired benefits to the laundry or other surface being treated. Alternatively, many of the finishing components can be incorporated into the treatment composition to impart the desired benefit during the treatment step. When used as a finishing composition, it is expected that certain components can be advantageously incorporated into the treatment composition. In addition, it is expected that many of the components may provide a desired benefit even if the treatment composition is not used as a finishing composition. That is, certain components may provide an advantageous affect when used in the treatment composition even when there may be additional steps subsequent to the treatment step. Exemplary additional components include anti-redeposition agents, optical brighteners, sequestrants, builders, water conditioning agents, oil and water repellant agents, color fastness agents, starch/sizing agents, fabric softening agents, souring agents, iron controlling agents, and fragrances.

Anti-redeposition agents can be used to facilitate sustained suspension of soils in a use solution and reduce the tendency of the soils to be redeposited onto a substrate from which they have been removed. Exemplary anti-redeposition agents include fatty acid amides, fluorocarbon surfactants, complex phosphate esters, styrene maleic anhydride copolymers, and cellulosic derivatives such as carboxymethyl cellulose, hydroxyethyl cellulose, hydroxypropyl cellulose, and the like. Specific exemplary anti-redeposition agents include styrene maleic anhydride copolymers, sodium tripolyphosphate, sodium carboxymethyl cellulose, polyvinylpyrrolidone, acrylic acid polymers, and maleic/olefinic copolymers.

The treatment composition can be provided without an anti-redeposition agent. When an anti-redeposition agent is included in the treatment composition, it can be provided in an amount of between about 0.05 wt. % and about 50 wt. %, in an amount of between about 0.1 wt. % and about 40 wt. %, and in an amount of between about 0.5 wt. % and about 7 wt. % when the composition is provided in the form of a concentrate.

Optical brightener, which can also be referred to as fluorescent whitening agent or fluorescent brightening agent, provides optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners can absorb light in the ultraviolet range (e.g., 275-400 nm) and can emit light in the ultraviolet blue spectrum (e.g., 400-500 nm).

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions should contain a mixture of brighteners which are effective for a variety of fabrics. It is of course necessary that the individual components of such a brightener mixture be compatible.

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. Preferred optical brighteners include stilbene derivatives.

A cleaning composition can include, for example, up to about 4 wt. %, about 0.05 to about 2 wt. %, about 0.1 to about 0.5 wt. %, or about 0.1 to about 0.2 wt. % optical brightener. In an embodiment, the optical brightener is present at about 0.1 wt. % or at about 0.25 wt. %. The composition can include any of these ranges or amounts not modified by about.

The treatment composition can include a sequestrant. In general, a sequestrant is a molecule capable of coordinating (i.e., binding) the metal ions commonly found in natural water to prevent the metal ions from interfering with the action of the other detersive ingredients of a cleaning composition. Some chelating/sequestering agents can also function as a threshold agent when included in an effective amount. For a further discussion of chelating agents/sequestrants, see Kirk-Othmer, Encyclopedia of Chemical Technology, Third Edition, volume 5, pages 339-366 and volume 23, pages 319-320.

A variety of sequestrants can be used including, for example, organic phosphonate, aminocarboxylic acid, condensed phosphate, inorganic builder, polymeric polycarboxylate, mixture thereof, or the like. Such sequestrants and builders are commercially available. Suitable condensed phosphates include sodium and potassium orthophosphate, sodium and potassium pyrophosphate, sodium and potassium tripolyphosphate, sodium hexametaphosphate, preferably of tripolyphosphate. In an embodiment, the cleaning composition includes as a builder, chelator, or sequestrant a condensed phosphate, such as sodium tripolyphosphate. Polycarboxylates suitable for use as cleaning agents include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, polymaleic acid, polyfumaric acid, copolymers of acrylic and itaconic acid, and the like. Preferred polycarboxylates include polyacrylate.

In an embodiment, the treatment composition includes as sequestrant or builder condensed phosphate and polyacrylate, or another polymer, for example, sodium tripolyphosphate and polyacrylate. Sodium salts of condensed phosphates are preferred to the corresponding potassium salts.

The builder can include an organic phosphonate, such as an organic-phosphonic acid and alkali metal salts thereof. Some examples of suitable organic phosphonates include:

1-hydroxyethane-1,1-diphosphonic acid: $CH_3C(OH)[PO(OH)_2]_2$;

aminotri(methylenephosphonic acid): $N[CH_2PO(OH)_2]_3$;

aminotri(methylenephosphonate), sodium salt

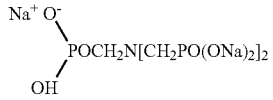

2-hydroxyethyliminobis(methylenephosphonic acid): $HOCH_2CH_2N[CH_2PO(OH)_2]_2$;

diethylenetriaminepenta(methylenephosphonic acid): $(HO)_2POCH_2N[CH_2CH_2N[CH_2PO(OH)_2]_2]_2$;

diethylenetriaminepenta(methylenephosphonate), sodium salt: $C_9H_{(28-x)}N_3Na_xO_{15}P_5$ (x=7);

hexamethylenediamine(tetramethylenephosphonate), potassium salt: $C_{10}H_{(28-x)}N_2K_xO_{12}P_4$ (x=6);

bis(hexamethylene)triamine(pentamethylenephosphonic acid): $(HO_2)POCH_2N[(CH_2)_6N[CH_2PO(OH)_2]_2]_2$; and phosphorus acid $H_3PO_3$; and other similar organic phosphonates, and mixtures thereof.

The sequestrant can be or include aminocarboxylic acid type sequestrant. Suitable aminocarboxylic acid type sequestrants include the acids or alkali metal salts thereof, e.g., amino acetates and salts thereof. Some examples include N-hydroxyethylaminodiacetic acid; hydroxyethylenediaminetetraacetic acid, nitrilotriacetic acid (NTA); methylglycinediacetic acid (MGDA); 2-hydroxyethylaminodiacetic acid (HEIDA); ethylenediaminetetraacetic acid (EDTA); N-hydroxyethyl-ethylenediaminetriacetic acid (HEDTA); diethylenetriaminepentaacetic acid (DTPA); and alanine-N, N-diacetic acid; and the like; and mixtures thereof.

Preferred aminocarboxylates include the sodium salt of EDTA, MGDA, and HEIDA.

An exemplary sequestrant or builder that can be used includes iminodisuccinic acid (IDS) and salt of iminodisuccinic acid. Such sequestrants are desirable because they are generally considered to be more environmentally friendly compared with other sequestrants.

It should be understood that the sequestrant and/or builder are optional components. When the treatment composition includes a sequestrant and/or builder, the sequestrant and/or builder can be provided in an amount of between about 0.5 wt. % and about 85 wt. %, in an amount of between about 2 wt. % and about 40 wt. %, and in an amount of between about 4 wt. % and about 20 wt. %.

Exemplary oil and water repellant agents that can be used include fluoropolymers and hydrocarbon wax materials. It should be understood that the oil and water repellant agents are optional, but when they are included in the treatment composition concentrate, they can be included in amounts of about 1 wt. % to about 40 wt. %, about 2 wt. % to about 20 wt. %, and about 5 wt. % to about 15 wt. %.

Exemplary color fastness agents that can be used include polyvinyl pyrrolidone and quaternary amines. It should be understood that the color fastness agents are optional, but when they are used, they can be used in the treatment composition concentrate in amounts of between about 0.1 wt. % and about 10 wt. %, about 0.2 wt. % and about 5 wt. %, and about 0.5 wt. % and about 3 wt. %.

The treatment composition can include starch/sizing agents as optional components. Exemplary starch/sizing agents that can be used include polyvinyl acetates, corn starch, rice starch, and wheat starch. When starch/sizing agents are used in the treatment composition concentrate, they can be included at levels of between about 1 wt. % and about 50 wt. %, about 2 wt. % and about 25 wt. %, and about 3 wt. % and about 10 wt. %.

The treatment composition can include softening agents. Exemplary softening agents include quaternary ammonium compounds such as alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis (2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyl-dialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Varisoft®. Exemplary amidoamine quaternary ammonium compounds that can be used according to the invention are methyl-bis(tallow amidoethyl)-2-hydroxyethyl ammonium methyl sulfate, methyl bis (oleylamidoethyl)-2-hydroxyethyl ammonium methyl sulfate, and methyl bis (hydr.tallowamidoethyl)-2-hydroxyethyl ammonium methyl sulfate. Exemplary ester quaternary compounds are available under the name Stephantex™.

The quaternary ammonium compounds can include any counter ion that allows the component to be used in a manner that imparts fabric-softening properties. Exemplary counter ions include chloride, methyl sulfate, ethyl sulfate, and sulfate.

It should be understood that the softening agents are optional components and need not be present in the treatment composition. When fabric softening agents are incorporated into the treatment composition concentrate, they can be included in amounts of between about 0.5 wt. % and about 50 wt. %, between about 2 wt. % and about 30 wt. %, and between about 4 wt. % and about 20 wt. %.

The treatment composition can include souring agents to neutralize alkalinity. Exemplary souring agents include hydrofluorosilicic acid (HFS), citric acid, phosphoric acid, formic acid, and oxalic acid. It should be understood that the souring agent is optional and need not be present in the treatment composition. When the treatment composition includes a souring agent, it can be included in an amount sufficient to provide neutralization.

Detergent Composition

The treatment composition can include a detergent composition to provide a desired level of soil removal. For example, the treatment composition can be used to provide cleaning, bleaching, and antimicrobial properties. In many applications, however, it is expected that a washing step that includes washing with a detergent composition will precede or follow a treatment step that provides bleaching and antimicrobial properties.

The detergent composition that can be used with the treatment composition or preceding or following the treatment composition according to the invention is expected to provide a desired level of soil removal when used in a machine washing environment. The detergent composition can be a conventionally available detergent composition. Exemplary components in detergent compositions include a source of alkalinity, surfactants, builders, sequestrants, suds boosters or suds suppressors, anti-tarnish and anti-corrosion agents, soil suspending agents, soil release agents, pH adjusting agents, chelating agents, enzymes, enzyme-stabilizing agents, bleach activators, and solvents.

The source of alkalinity can be provided when it is desirable to increase the pH of the detergent use solution. Conditions for the removal of soil are often favorable at higher pH values. Exemplary sources of alkalinity include alkali metal hydroxides, such as sodium hydroxide, potassium hydroxide, and mixtures thereof; alkali metal silicates such as sodium metal silicate; alkali metal carbonates, alkali metal bicarbonates, alkali metal sesquicarbonates, and alkali metal borates. Sodium hydroxide can be used in an aqueous solution and in a variety of solid forms in varying particle sizes. The carbonate and borate sources are typically used in place of alkali metal hydroxide when a lower pH is desired.

Useful anionic surfactants include the water soluble salts, such as the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$-$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Examples include linear straight chain alkylbenzene sulfonates in which the average number of carbon atoms in the alkyl group is from about 11 to 14, abbreviated as $C_{11-14}$ LAS. Also, examples include mixtures of $C_{10-16}$ (preferably $C_{11-13}$) linear alkylbenzene sulfonates and $C_{12-18}$ (preferably $C_{14-16}$) alkyl sulfates, alkyl ether sulfates, alcohol ethoxylate sulfates, etc.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Also useful are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility and are most preferred in compositions of the present invention.

Examples of suitable synthetic, water soluble anionic compounds are the alkali metal (such as sodium, lithium and potassium) salts or the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl naphthalene sulfonate, dialkyl naphthalene sulfonate and alkoxylated derivatives. Other anionic detergents are the olefin sulfonates, including long chain alkene sulfonates, long chain hydroxyalkane sulfonates or mixtures of alkenesulfonates and hydroxyalkane-sulfonates and alkylpoly (ethyleneoxy) ether sulfonates. Also included are the alkyl sulfates, alkyl poly (ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Water soluble nonionic surfactants are also useful in the instant detergent granules. Such nonionic materials include compounds produced by the condensation of alkylene oxide groups (hydrophilic in nature) with an organic hydrophobic group or compound, which may be aliphatic or alkyl in nature. The length of the polyoxyalkylene group which is condensed with any particular hydrophobic group can be readily adjusted to yield a water soluble compound having the desired degree of balance between hydrophilic and hydrophobic elements.

Included are the water soluble and water dispersible condensation products of aliphatic alcohols containing from 8 to 22 carbon atoms, in either straight chain or branched configuration, with from 3 to 12 moles of ethylene oxide per mole of alcohol.

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkylene oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Useful nonionic surfactants include block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade name PLURONIC® manufactured by BASF Corp. PLURONIC® compounds are difunctional (two reactive hydrogens) compounds formed by condensing ethylene oxide with a hydrophobic base formed by the addition of propylene oxide to two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. TETRONIC® compounds are tetra-functional block copolymers derived from the sequential additional of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Also useful nonionic surfactants include the condensation products of one mole of alkyl phenol wherein the alkyl constituent, contains from about 8 to about 18 carbon atoms with from about 3 to about 50 moles of ethylene oxide. The alkyl group can, for example, be represented by diisobutylene, di-amyl, polymerized propylene, isoctyl, nonyl, and di-nonyl. Examples of commercial compounds of this chemistry are available on the market under the trade name IGEPAL® manufactured by Rhone-Poulenc and TRITON® manufactured by Union Carbide.

Likewise useful nonionic surfactants include condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade name NEODOL® manufactured by Shell Chemical Co. and ALFONIC® manufactured by Vista Chemical Co. A preferred class of nonionic surfactants are nonyl phenol ethoxylates, or NPE.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above delineated carbon atoms range or it can consist of an acid having a specific number of carbon atoms within the range. Examples of commercial compounds of this chemistry are available on the market under the trade name NOPALCOL® manufactured by Henkel Corporation and LIPOPEG® manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

Tertiary amine oxides corresponding to the general formula:

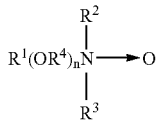

can be used wherein the bond is a conventional representation of a semi-polar bond; and $R^1$, $R^2$, and $R^3$ may be aliphatic, aromatic, heterocyclic, alicyclic groups or a combination of such groups thereof. Generally, for amine oxides of detergent interest, $R^1$ is an alkyl radical of from about 8 to about 24 carbon atoms; $R^2$ and $R^3$ are selected from the group consisting of alkyl or hydroxyalkyl of 1-3 carbon atoms and mixtures thereof; $R^4$ is an alkylene or a hydroxyalkylene group containing 2 to 3 carbon atoms; and n ranges from 0 to about 20. Useful water soluble amine oxide surfactants are selected from the coconut or tallow dimethyl amine oxides.

Semi-polar nonionic surfactants include water soluble amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxylalkyl moieties of from about 1 to 3 carbon atoms. Nonionic surfactants are of the formula $R^1(OC_2H_4)_nOH$, wherein $R^1$ is a $C_6$-$C_{16}$ alkyl group and n is from 3 to about 80 can be used. Condensation products of $C_6$-$C_{15}$ alcohols with from about 5 to about 20 moles of ethylene oxide per mole of alcohol, e.g., $C_{12}$-$C_{14}$ alcohol condensed with about 6.5 moles of ethylene oxide per mole of alcohol.

Amphoteric surfactants include derivatives of aliphatic or aliphatic derivatives of heterocyclic secondary and tertiary amines in which the aliphatic moiety can be straight chain or branched and wherein one of the aliphatic substituents contain from about 8 to 18 carbon atoms and at least one aliphatic substituent contains an anionic water solubilizing group.

Cationic surfactants can also be included in the present detergent granules. Cationic surfactants include a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Additional ingredients that can be included in the detergent composition include those components described in U.S. Pat. No. 3,936,537, incorporated herein by reference.

Builders (or sequestrants) are employed to sequester hardness ions and to help adjust the pH of the laundering liquor. Such builders can be employed in concentrations up to about 85% by weight, preferably from about 0.5% to about 50% by weight, most preferably from about 10% to about 30% by weight, of the compositions herein to provide their builder and pH-controlling functions. The builders herein include any of the conventional inorganic and organic water soluble builder salts. Such builders can be, for example, water soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates. Nonphosphorus-containing materials can also be selected for use herein as builders.

Specific examples of nonphosphorus, inorganic detergent builder ingredients include water soluble bicarbonate, and silicate salts. the alkali metal, e.g., sodium and potassium, bicarbonates, and silicates are particularly useful herein.

Water soluble, organic builders are also useful herein. For example, the alkali metal, polycarboxylates are useful in the present compositions. Specific examples of the polycarboxylate builder salts include sodium and potassium salts of ethylenediaminetetraacetic acid, nitrilotriacetic acid, oxydisuccinic acid, mellitic acid, benzene polycarboxylic acid, polyacrylic acid, polymaleic acid, iminodisuccinic acid, methylglycinediacetatic acid, and 2-hydroxyethyliminodiacetic acid.

Other desirable polycarboxylate builders are the builders set forth in U.S. Pat. No. 3,308,067, incorporated herein by reference. Examples of such materials include the water soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226 and U.S. Pat. No. 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization alkaline solution, converted to the corresponding salt, and added to a surfactant.

Chelating agents are also described in U.S. Pat. No. 4,663,071, incorporated herein by reference. Suds modifiers are also optional ingredients and are described in U.S. Pat. Nos. 3,933,672, and 4,136,045, both incorporated herein by reference. The following examples were carried out to evaluate bleaching and antimicrobial properties of treatment compositions.

EXAMPLE 1

Bleaching performance as a function of pH was evaluated using peroxyacetic acid.

Tea stains were prepared on cotton swatches obtained from Test Fabrics, Inc. of Pennsylvania. The staining was evaluated on a Hunterlab Ultrascan. The stained cotton swatches were placed in a tergotometer pot and washed for 10 minutes in the presence of 240 ppm peroxyacetic acid at 120° F., then rinsed and read on a Hunterlab Ultrascan. Various test runs were conducted adjusting the pH using acetic acid and sodium hydroxide.

Figure 2:
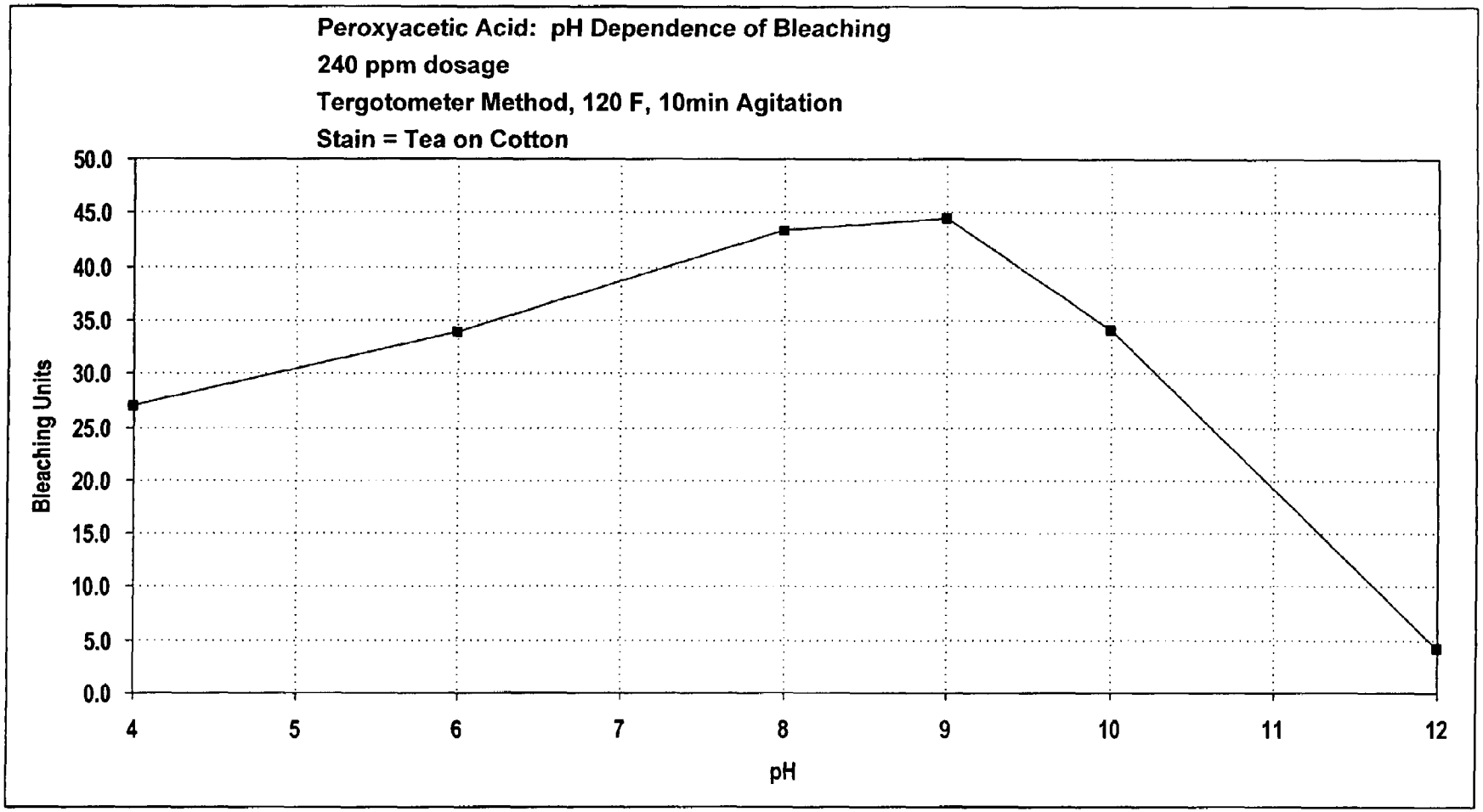
FIG. 2 is a graph showing bleaching performance as a function of pH for peroxyacetic acid according to Example 1.

The results of Example 1 are reported in FIG. 2.

EXAMPLE 2

Figure 3:
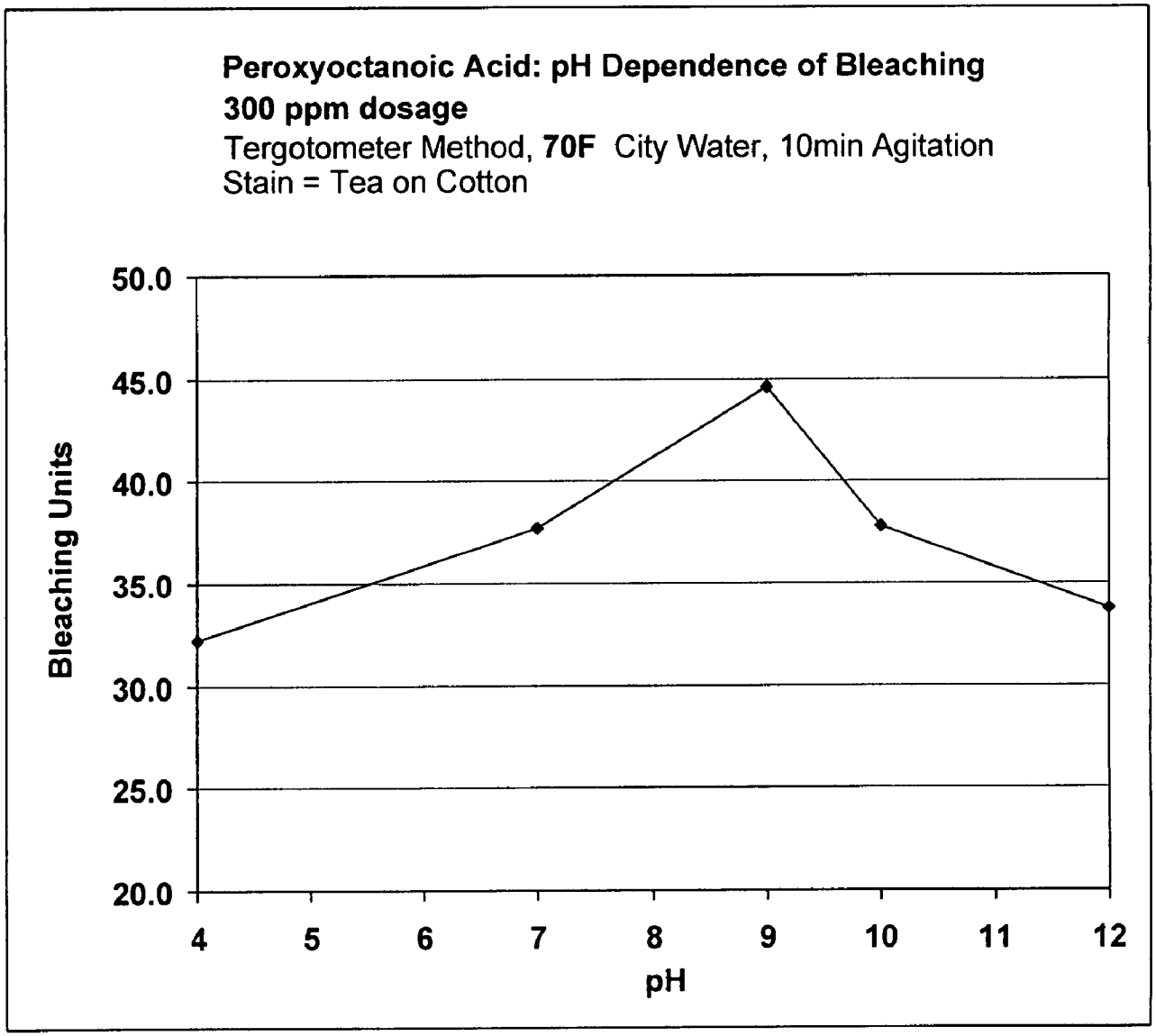
FIG. 3 is a graph showing bleaching performance as a function of pH for peroxyoctanoic acid according to Example 2.

The procedure of Example 1 was repeated except that peroxyoctanic acid was used at 300 ppm at a temperature of 70° F. The results are reported in FIG. 3.

EXAMPLE 3

Figure 4:
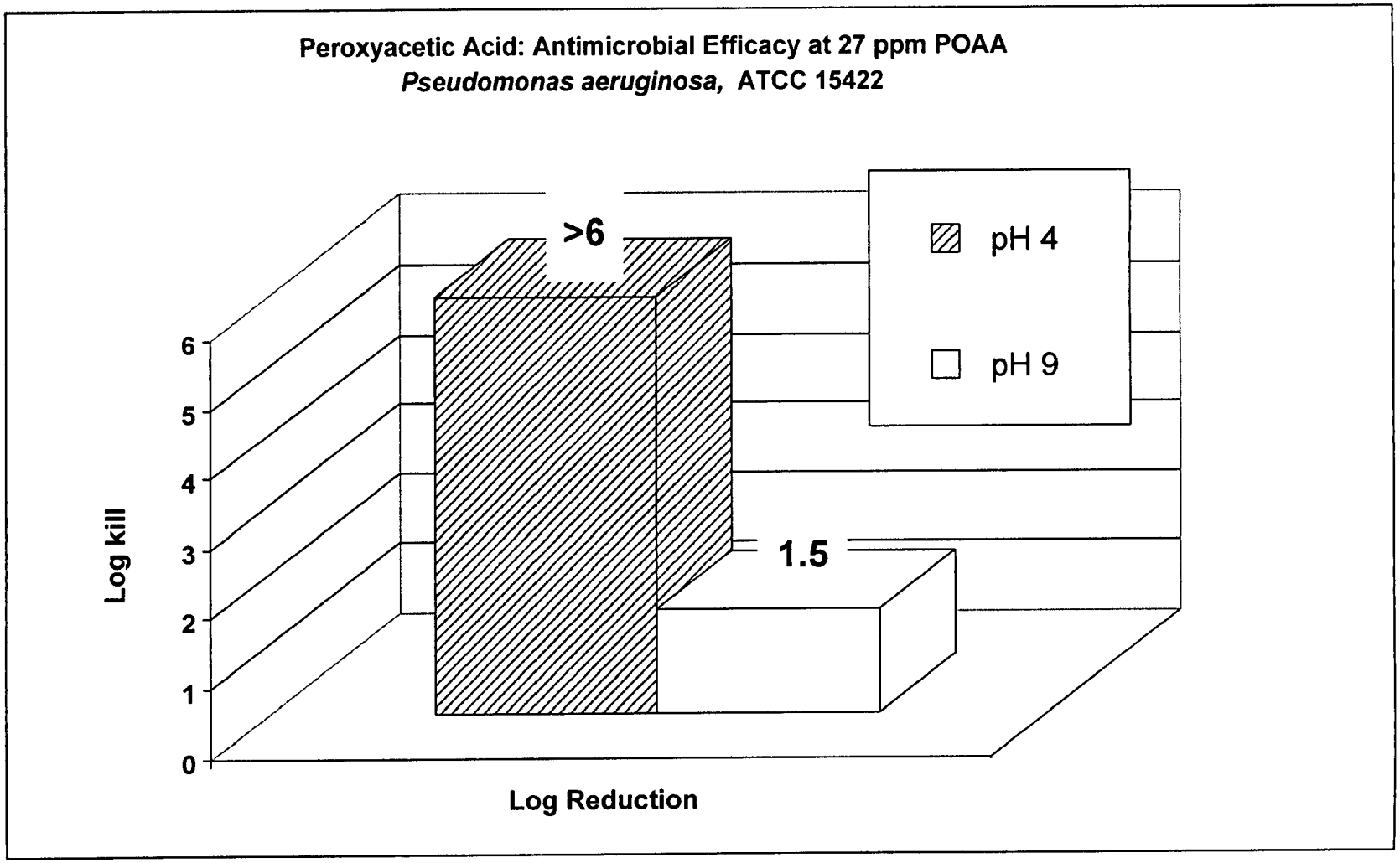
FIG. 4 is a graph showing antimicrobial efficacy of peroxyacetic acid against *Pseudomonas aeruginosa* as a function of pH as reported in Example 3.

Solutions of peroxyacetic acid were tested at pH 4 and 9 at an activity of 27 ppm against *Pseudomonas aeruginosa*. In order to achieve this, the product was diluted with phosphate buffered dilution water versus synthetic hard water to reduce the effects of the hard water on the product. The pH of peroxyacetic acid was adjusted after mixing with the phosphate buffered solution water. For the solution at pH of 4, no adjustment was necessary due to the initial pH of 4.13. To achieve the peroxyacetic acid at a pH of 9, 14 drops of 3.6% hydrochloric acid was added to the solution followed by 2 drops of 4.0% sodium hydroxide for a final pH of 9.01. The temperature was 120° F. and the contact time was 15 seconds. The inoculum number was $1.3\times10^3$ CFL/ml. The results of this example are reported in FIG. 4.

EXAMPLE 4

This example was conducted to evaluate the effect of pH on ozone bleaching of a tea stained polyester-cotton-blend fabric.

The apparatus used for this example included a closed-loop pipe-line-and-tank capable of holding about 120 gallons of water. The tank mainly serves to add enough liquid capacity to control steady state conditions. The line has an optional by-pass that contains two clear sample containers where liquid flowing through the system can flow through the sample containers. Swatches can be placed inside the sample containers and exposed to flowing liquid through the system for specified times. Each sample container can be independently removed from the line at a specified time.

Duplicate swatches of tea stained polyester-cotton-blend where placed inside each of the two sample containers. The water in the system was adjusted to the desired pH with either HCl or NaOH depending on the pH desired. The ozone system was turned on and the liquid was ozonated via a venturi system until the dissolved ozone level in the liquid reached the desired level. At the start time of the bleaching experiment, the by-pass was opened and the liquid was allowed to flow through the swatches. The liquid temperature and pH where recorded during the experiment. The dissolved ozone level was also recorded several times during the experiment using a Hach Inc. Ozone test kit *Indigo* Blue method 8311.

Figure 5:
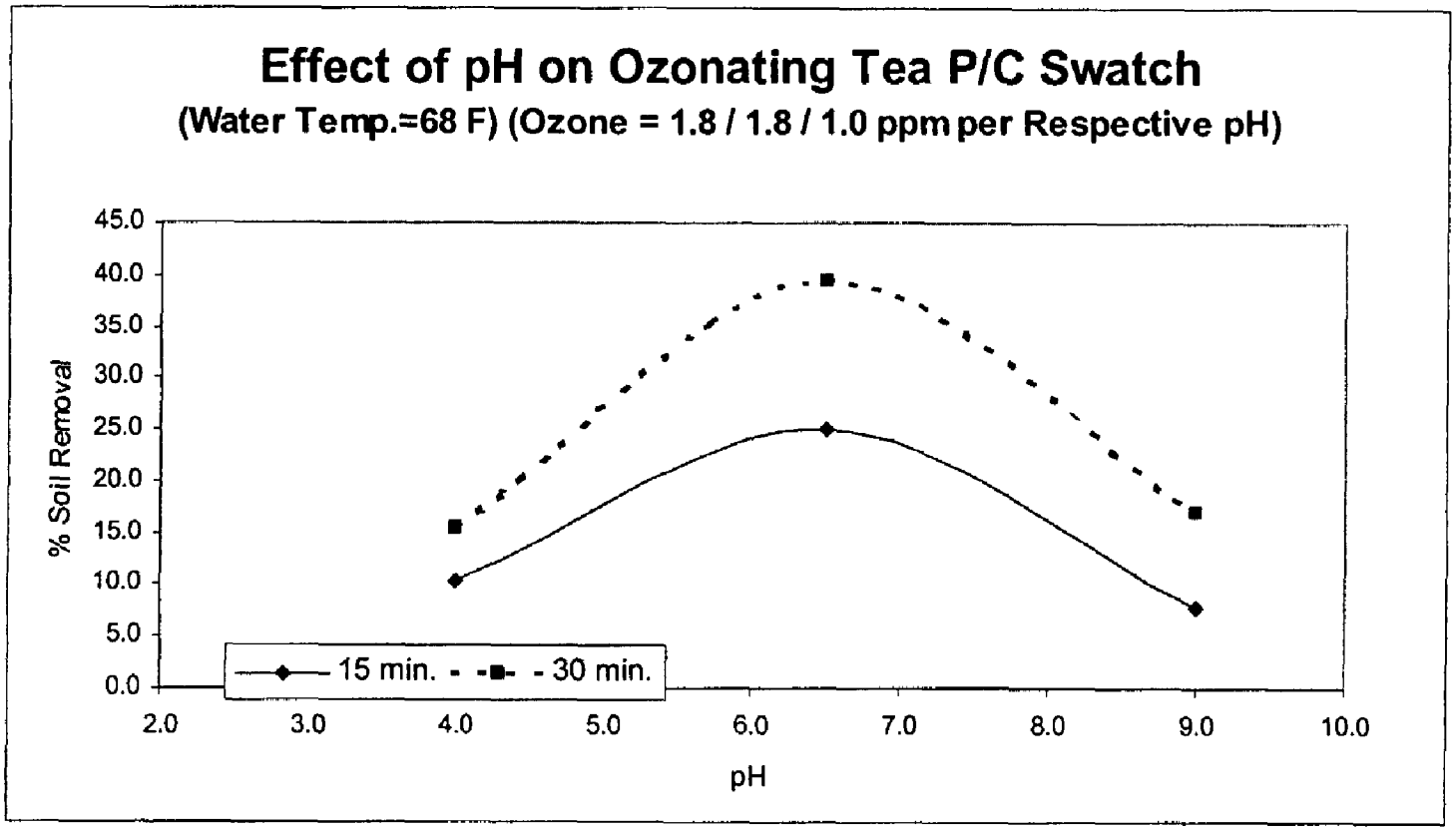
FIG. 5 is a graph showing bleaching (reported as % soil removal) for tea stains as a function of pH for ozone according to Example 4.

The swatches were exposed to ozonated water (67 to 69° F.) at specified pH, and the water contained between 1 and 2 ppm of dissolved ozone. One duplicate set of swatches was exposed to the test conditions for 15 minutes, and another duplicate set for 30 minutes. After the swatches were removed from the system at the specified times, the swatches were allowed to dry and then read in a Hunter colorimeter for "%Soil Removal." The results are reported in FIG. 5.

Ozonated water at room temperature containing enough dissolved ozone (around 1 ppm or higher) can be used to bleach tea stained swatches when the swatches are exposed to the dissolved ozone conditions for enough time. This experiment shows that the pH needs to be closely controlled, as bleaching with ozonated water strongly depends on the pH conditions. In this experiment, a pH around neutral (pH=6.5) gave the highest bleaching. At the acid condition (pH=4.0), and at the basic condition (pH=9.0), bleaching was minimal.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for treating laundry, the method comprising:

(a) washing the laundry with a detergent use solution at an alkaline pH in an industrial laundry washing machine for removal of soil from the laundry; and thereafter draining at least a portion of the detergent use solution from the laundry washing machine; and thereafter (b) applying a laundry treatment composition comprising a bleaching/antimicrobial agent selected from the group consisting of a halogen bleach, an oxygen bleach, and mixtures thereof, to the laundry in an industrial laundry washing machine at a pH from about 2 to about 4 for about 3 minutes to about 10 minutes, and thereafter at a pH from about 8 to about 11 for about 3 minutes to about 10 minutes; wherein a pH adjusting agent is added to increase the pH; and (c) draining the laundry treatment composition from the laundry.

2. A method according to claim 1, wherein the laundry treatment composition further comprises a detergent composition for removal of soil from the laundry.

3. A method according to claim 1, wherein the pH adjusting agent comprises at least one of alkaline metal hydroxide, alkaline metal silicate, alkaline metal carbonate, alkaline metal bicarbonate, alkaline metal sesquicarbonate, and alkaline metal borate.

4. A method according to claim 1, wherein the laundry treatment composition comprises a coated pH adjusting agent that introduces the pH adjusting agent once the coating has degraded.

5. A method according to claim 1, wherein the halogen bleach comprises at least one of chlorine dioxide, potassium dichloroisocyanurate, sodium dichloroisocyanurate, chlorinated trisodiumphosphate, sodium hypochlorite, calcium hypochlorite, lithium hypochlorite, monochloramine, dichloroamine, [(monotrichloro)-tetra (monopotassium dichloro)] pentaisocyanurate, paratoluene sulfondichloro-amide, trichloromelamine, N-chlorammeline, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethyl hydantoin, 1-3-dichloro-5-ethyl-5-methyl hydantoin, 1-choro-3-bromo-5-ethyl-5-methyl hydantoin, dichlorohydantoin, salts or hydrates thereof, and mixtures thereof.

6. A method according to claim 1, wherein the oxygen bleach comprises an inorganic active oxygen composition comprising at least one of hydrogen peroxide, hydrogen peroxide adduct, ozone, group IIIA active oxygen compound, group VIA active oxygen compound, group VA active oxygen compound, group VIIA active oxygen compound, and mixtures thereof.

7. A method according to claim 1, wherein the oxygen bleach comprises at least one of a peroxycarboxylic acid, an ester of peroxycarboxylic acid, an alkaline metal salt of a peroxycarboxylic acid, and adducts thereof.

8. A method according to claim 1, wherein the oxygen bleach comprises at least one of $C_1$-$C_{10}$ aliphatic peroxycarboxylic acid, salt of $C_1$-$C_{10}$ aliphatic peroxycarboxylic acid, ester of $C_1$-$C_{10}$ aliphatic peroxycarboxylic acid, and mixture thereof.

9. A method according to claim 1, wherein the oxygen bleach comprises peroxyoctanoic acid.

10. A method according to claim 1, wherein the laundry treatment composition further comprises an activator.

11. A method according to claim 1, wherein the laundry treatment composition further comprises at least one of souring agents, fabric softening agents, starch, sizing agents, color-fastness agents, oil and water repellant agents, water conditioning agents, iron controlling agents, water threshold agents, soil releasing agents, soil shielding agents, optical brightening agents, fragrances, and mixtures thereof.

12. A method according to claim 1, further comprising a step of rinsing the laundry treatment composition from the laundry.

* * * * *